United States Patent [19]

Adamek et al.

[11] 4,265,551

[45] May 5, 1981

[54] DRIVE FOR TRANSPORTING AND REVERSING AN INK RIBBON, AND FOR WITHDRAWING THE PRINTING HEAD IN PRINTING DEVICES

[75] Inventors: Manfred Adamek, Freusburg-Struth; Horst Würscher, Wilusdorf, both of Fed. Rep. of Germany

[73] Assignee: U.S. Philips Corporation, New York, N.Y.

[21] Appl. No.: 918,406

[22] Filed: Jun. 23, 1978

[30] Foreign Application Priority Data

Jul. 13, 1977 [DE] Fed. Rep. of Germany ..... 2731593
Jul. 13, 1977 [DE] Fed. Rep. of Germany ..... 2731607

[51] Int. Cl.[3] ..... B41J 33/44

[52] U.S. Cl. ..... 400/221.1; 400/55; 400/219.5; 400/225; 400/229; 400/234; 400/245; 400/124

[58] Field of Search ..... 400/55, 59, 124, 192, 400/219.5, 221, 221.1, 222, 225, 229, 236.2, 245, 320

[56] References Cited

U.S. PATENT DOCUMENTS

| | | | |
|---|---|---|---|
| 2,654,461 | 10/1953 | Bovio | 400/219.5 |
| 2,998,878 | 9/1961 | Biedinger et al. | 400/245 |
| 3,038,582 | 6/1962 | Frechette et al. | 400/221.1 X |
| 3,587,813 | 6/1971 | Dugeny et al. | 400/221.1 X |
| 3,807,544 | 4/1974 | Glover | 400/245 X |
| 3,842,958 | 10/1974 | Link | 400/320 X |
| 3,904,010 | 9/1975 | Krauss et al. | 400/320 X |
| 3,990,563 | 11/1976 | Adamek et al. | 400/236.2 X |

FOREIGN PATENT DOCUMENTS

| | | | |
|---|---|---|---|
| 33257 | 2/1911 | Denmark | 400/221.1 |
| 1021412 | 12/1957 | Fed. Rep. of Germany . | |
| 2321017 | 11/1974 | Fed. Rep. of Germany | 400/124 |
| 2462096 | 1/1976 | Fed. Rep. of Germany . | |

*Primary Examiner*—Ernest T. Wright, Jr.
*Attorney, Agent, or Firm*—Robert S. Smith

[57] ABSTRACT

In order to enable ink ribbon transport and ribbon reversal on the one hand and on the other hand the withdrawal of the printing head from the platen to be performed by means of only a single motor, a pawl-and-ratchet device is provided between the drive gearwheels for the reel holders and the drive motor. The cord for the withdrawal of the printing head is connected to a deflection lever which follows the profile of a cam disc of a cam mechanism, which is connected via a further pawl-and-ratchet device to the common shaft driven by the electric motor. The two pawl-and-ratchet devices drive in opposed directions. The common drive motor is reversible and is electrically controlled by the cam mechanism.

5 Claims, 4 Drawing Figures

Figure 1:
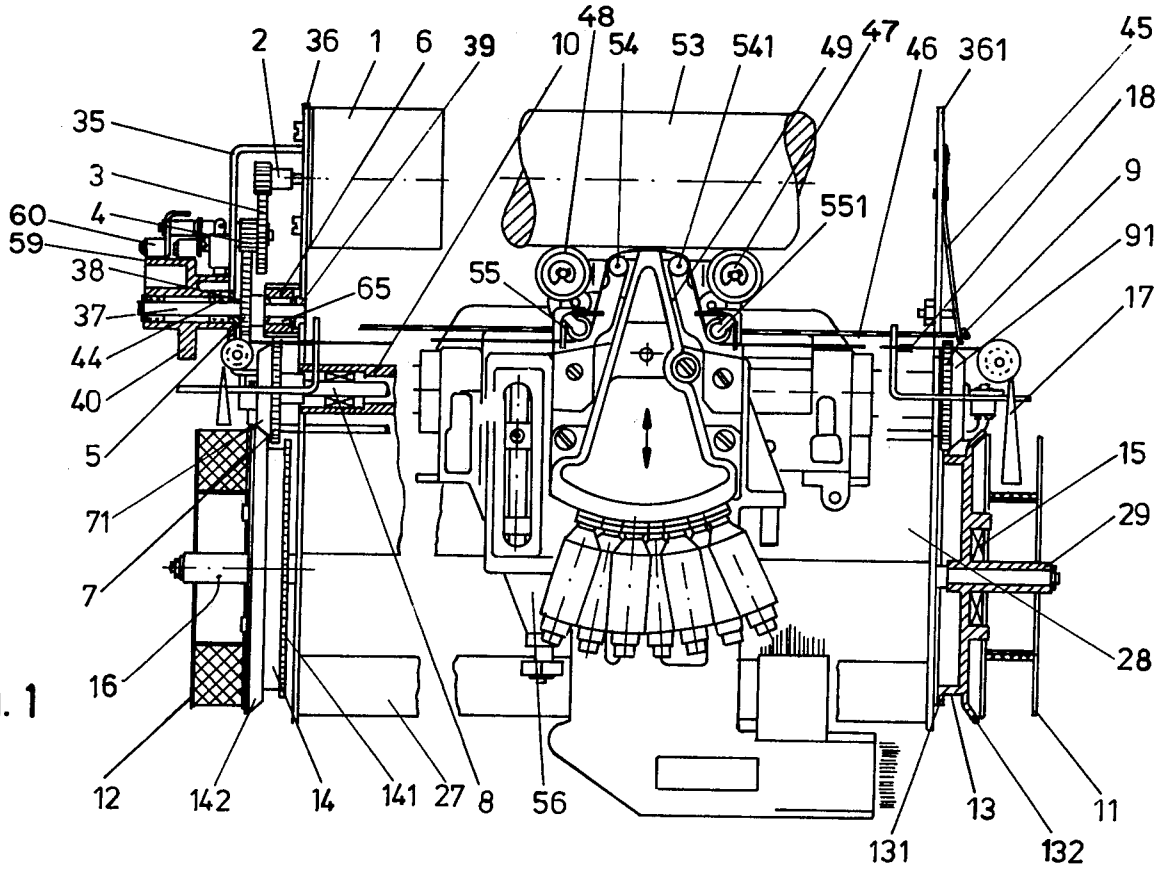

DRIVE FOR TRANSPORTING AND REVERSING AN INK RIBBON, AND FOR WITHDRAWING THE PRINTING HEAD IN PRINTING DEVICES

The invention relates to a drive for transporting and reversing the transport direction of an ink ribbon and for withdrawing the printing head from the platen in a printing device of a typewriter or accounting machine in which the ribbon is reversed and transported by means of gearwheels which are rigidly connected to each other via a control shaft, said gearwheels alternately engaging, by sliding of the control shaft in the longitudinal direction, associated gear rings on reel holders arranged in the sides of the printing device, the withdrawal of the printing head being effected by the tensioning of a cord which is secured at one end to the printing device and which is guided over the printing head via guide rollers.

German Offenlegungsschrift 19 23 498 describes a device for transporting or reversing an ink ribbon in which a gearwheel, notably a worm wheel, is associated with each reel holder. These two gearwheels are connected to each other via a control shaft which is journalled to be slidable. When the ribbon has been unwound, further movement of the ribbon is prevented by the empty reel. The control shaft, actuated by a motor via a gearwheel drive, is moved further in the prevailing direction, so that via the driving worm wheel a force is exerted in the longitudinal direction of the control shaft. This force causes shifting of the shaft as soon as it becomes larger than a force from a lost-motion switching device which prevents this shifting. The electric motor required for this drive always rotates in the same direction.

In typewriters and accounting machines it is also known to widthdraw the printing head from the platen in order to facilitate the insertion of the record carrier to be printed. German Auslegeschrift 10 21 412 describes a withdrawal device utilizing a cord which is secured on one side of the printing device, while it is connected to a rocking lever on the other side. At the area of the printing head, which is journalled to be slidable perpendicularly to the platen on a carriage which is movable along the platen, the cord is guided by at least three rollers, two of which are mounted adjacent the printing head on the carriage, while one roller is mounted on the printing head, shifted in the direction of the platen. When the rocking lever is actuated, the cord is tensioned, so that the roller mounted on the printing head is pulled in the direction of the plane containing the two rollers on the carriage.

For the control of the rocking lever there is provided an electric motor which is actuated as desired.

The invention has for its object to provide a drive which can be used for operating a transporting and reversing device for the ribbon as well as for withdrawing the printing device, when desired, so that only one electric motor is provided for both drive modes, the device having a simple construction for reversing the transport direction of the ribbon. In this respect it is assumed that the two drive modes do not occur simultaneously, because in typewriters and accounting machines printing never takes place when the printing head is in the withdrawn position.

The object in accordance with the invention is achieved in that one of the gearwheels cooperating with the gear rings on the reel holders is coupled via a pawl-and-ratchet device to a common drive shaft, the free end of the cord being connected to a deflection lever which follows the profile of a cam disc of a cam mechanism which is connected to the common drive shaft via a further pawl-and-ratchet device, the two pawl-and-ratchet devices being arranged to drive in opposite directions and the common drive shaft being drivable in a reversible manner by means of a single electric motor. The reversal of the drive shaft is preferably effected by electrical switching over of the electric motor. However, this can also be effected through a reversing gear mechanism, so that the electric motor constantly rotates in the same direction. Electrical control of the electric motor is simpler from a technical point of view and can be readily derived from the cam mechanism through switching devices. Because the cam mechanism cooperates with the common drive shaft during transport and reversal of the ink ribbon, the cam mechanism is preferably provided with a second cam disc comprising two approximately diametrically oppositely situated recesses in which a locking lever can engage for locking the deflection lever in one or the other of two extreme positions.

Each of the interconnected gearwheels and the associated gear rings are preferably provided with conical faces which face each other and slide on each other in opposed directions; the gearwheel and the associated gear ring do not mesh with each other. When the meshing gearwheel and gear ring disengage upon reversal of the transport direction of the ribbon, the teeth of the interconnected gearwheels can freely move in recesses which are arranged between the gear rings and the conical faces of the reel holders. Because the gearwheel and gear ring which do not mesh with each other are driven by the drive on the one hand and by the ribbon on the other hand in the same directions of rotation, their conical faces slide on each other in opposite directions. As a result, the reel holder from which the ribbon is being unwound is braked and the unwinding ink ribbon is constantly tensioned.

For reversing the transport direction of the ribbon, each gearwheel on the control shaft has associated with it a control lever which is deflectable against the face of the associated gearwheel by the ink ribbon, at least one of these control levers having associated with it a roller lever which is slidable against spring force, the cam face of the control lever having an inverted V-shape in the operating range of this roller lever. Both control levers are preferably rigidly connected to each other. The length of each slope of the inverted V-shaped cam face is slightly smaller than the distances between the control levers and the associated gearwheels. For maintaining these distances in a defined manner, the control levers are provided with projections. When the projection of a control lever contacts the face of the associated gearwheel during a reversing phase, the roller lever has just passed the top of the cam face and is situated at the beginning of the downward slope of the face. As a result, the spring force of the roller lever becomes effective to exert a force in the direction of the control shaft axis due to the force parallelogram then occurring. As a result, at the beginning of the shifting of the control shaft, the required force is completely provided by the spring of the roller lever. The ribbon is completely relieved for the actual reversing process. The force to be produced by the ribbon then concerns merely the deflection of the two control levers.

An embodiment of the device in accordance with the invention will be described in detail hereinafter with reference to the accompanying diagrammatic drawing.

Figure 2:
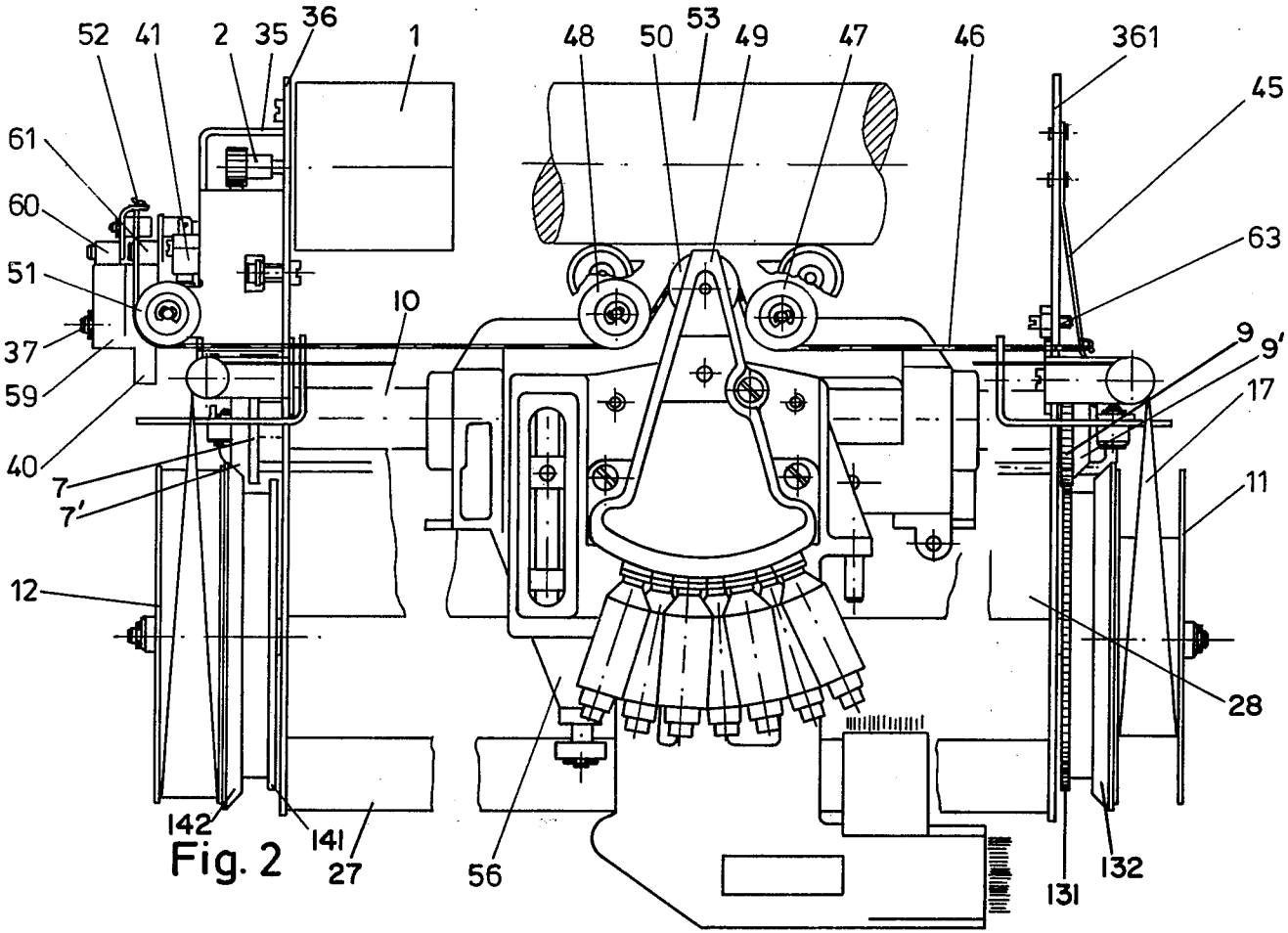
Figure 3:
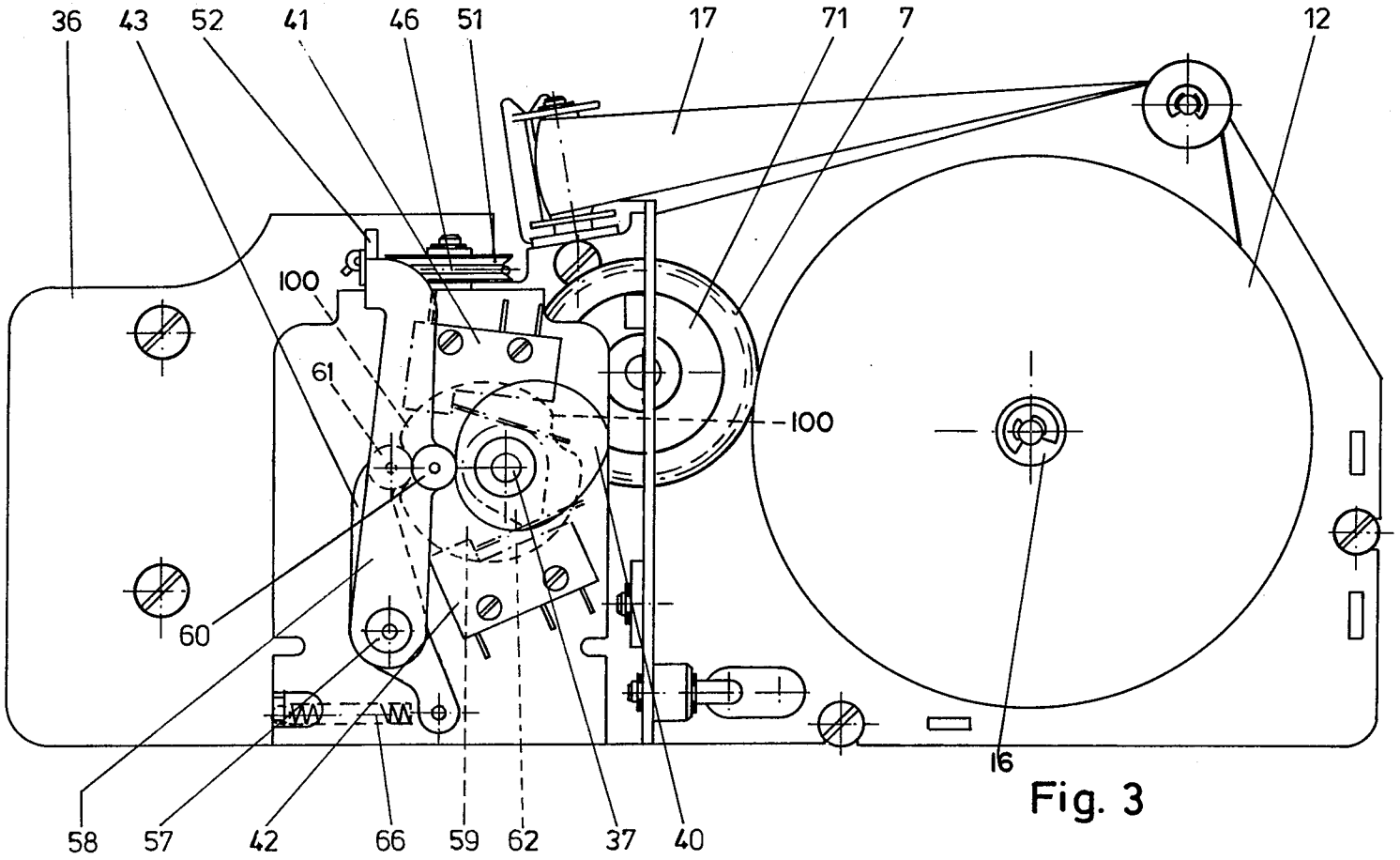
Figure 4:
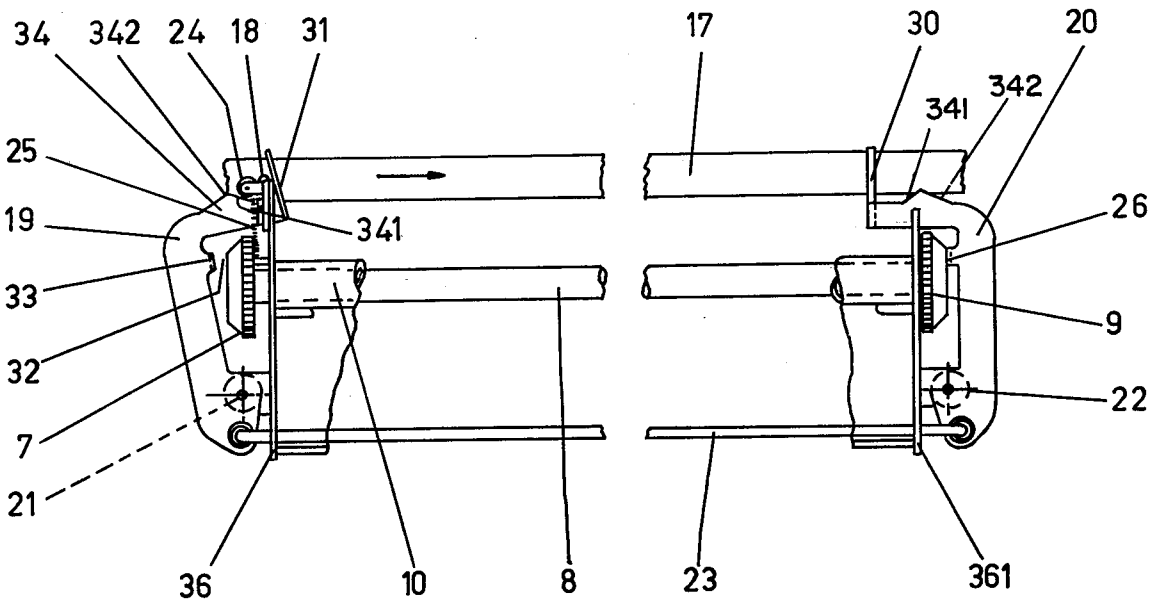

FIG. 1 is a partial sectional plan view of a printing device in accordance with the invention, FIG. 2 shows a plan view similar to FIG. 1, notably the withdrawal device being clearly shown, FIG. 3 is a side elevation of the device shown in FIG. 1, notably the cam mechanism being clearly shown, and FIG. 4 shows in partially schematic representation the device for reversing the transport direction of the ribbon.

The printing device shown in the drawing comprises housing walls 36 and 361 which are connected to each other by spacers 27 and 28. The platen 53 and the guide rails (formed by shaft 10 and spacer 27 which each have dual functions) for the transport carriage 56 of the printing head 49 are secured in the sidewalls 36 and 361. In the housing walls 36 and 361 there is also secured the hollow shaft 10 in which the control shaft 8 is journalled to be rotatable and slidable. Gearwheels 7 and 9 are rigidly mounted on the ends of the control shaft 8 which projects from the housing walls 36, 361. These gearwheels 7 and 9 alternately engage associated gear rings 141 and 131 due to the sliding of the control shaft 8. These gear rings 131, 141 form part of associated reel holders 13 and 14, on the mandrils 29 and 16 of which the ribbon reels 11 and 12 are supported. The robbon reels 11 and 12, usually made of metal, are maintained in position by permanent magnets 15 (shown on only one side). The ribbon 17 is guided over the face of the printing head 49 via rear deflection rollers 55 and 551 and front deflection rollers 54 and 541. All deflection rollers 54, 541, 55, 551 are journalled on the withdrawable printing head 49.

Both gearwheels 7 and 9 as well as both reel holders 13 and 14 comprise conical faces 71, 91 and 132, 142, respectively. The conical faces 71 and 142 face each other and the conical faces 91 and 132 face each other. The conical faces 71 and 142 of the gearwheel 7 and the associated gear ring 141 come into contact with each other when the gearwheel 71 and the gear ring 141 disengage after the reversing procedure. In the position of the control shaft 8 shown in FIG. 1, the gearwheel 9 and the gear ring 131 are in mesh with one another, and the conical faces 91 and 132 do not contact each other. The gearwheel 7 and the gear ring 141, however, are not in mesh, while the conical faces 71 and 142 contact each other. When the control shaft 8 is driven via the gearwheel 7, the reel holder 13, and hence the ribbon reel 11, is driven via the gearwheel 9. The ribbon 17 is thus unwound from the ribbon reel 12 and wound onto the ribbon reel 11. The gearwheel 7 and the reel holder 14 then rotate in the same direction, so that the conical faces 71 and 142 slide on each other in in opposite directions. Due to the resulting friction, the ribbon reel 12 is subjected to a force which acts in a direction opposite to the unwinding direction and which ensures constant tensioning of the ribbon 17. After the switching over of the control shaft 8, tensioning is provided by the frictional forces between the conical faces 91 and 132. The sliding of the control shaft 8, and hence the reversal of the transport direction of the ribbon 17, is effected in the manner to be described hereinafter with reference to FIG. 4.

On the housing sidewall 36 there is provided a mounting bracket 35 on which the gearing consisting of the gearwheels 3, 4 and 5 is mounted. This gearing is driven via the gearwheel 2 of an electric motor 1 which is mounted on the housing wall 36. The gearwheel 5 is mounted on a drive shaft 37 which is journalled in the housing wall 36 and the mounting bracket 35. This shaft 37 constitutes the common drive shaft for the ribbon transport and the withdrawal of the printing head 49. For driving the ribbon transport and for the switching of the control shaft 8, the shaft 37 is provided with a gearwheel 6 which is driven by the shaft 37, via a pawl-and-ratchet device 65, and which constantly meshes with the gearwheel 7. Due to the pressure of the pawl-and-ratchet device 65, when the common shaft 37 is driven in one direction by the electric motor 1, the driving force is transmitted to the gearwheel 7, while it is not transmitted thereto when the shaft 37 rotates in the other direction. The drive shaft 37, which is rotatably journalled in the bearing 39 in the housing wall 36, is extended via the bearing 38 in the mounting bracket 35, and the extension of this shaft 37 supports a cam mechanism. Via a pawl-and-ratchet device 44, this cam mechanism is rotatable with the common drive shaft 37 in one direction of rotation, the driving blocking direction of this pawl-and-ratchet device 44 being opposite to the driving direction of the pawl-and-ratchet device 65. This means that when the pawl-and-ratchet device 65 is driving, the pawl-and-ratchet device 44 is not driving. However, if the pawl-and-ratchet device 65 is not driving the pawl-and-ratchet device 44 is driving, thus transmitting the driving force from the electric motor 1 to the cam mechanism.

The cam mechanism comprises two cam discs 40 and 59. These two discs 40, 59 control two levers 43 and 58 which are journalled on a common rotary shaft 57. One end of the lever 43 is connected, via a spring 66, to the housing wall 36 and, as a result of the spring force, it engages in one or the other of two recesses 100 in the cam disc 59 through a roller 61. These recesses 100 are provided at approximately diametrically opposite positions and lock the cam mechanism in one or the other of the two extreme positions of the deflection lever 58, which is pivoted around the shaft 57 by its roller 60 following the profile of the cam disc 40. The deflection lever 58 comprises a projection 52 to which one end of the cord 46 is secured. Via a guide roller 51, the cord 46 is guided to the printing head 49 and is secured to a leaf spring 45 on the other side of the printing device, said spring 45 being rigidly connected to the housing wall 361. By means of the adjusting screw 63, tolerances in the length of the cord 46 can be compensated for. At the area of the printing head 49, the cord 46 is guided via three guide rollers 47, 48 and 50. The rollers 47 and 48 are journalled on the carriage 56, while the roller 50 is secured on the front portion of the printing head 49.

When the cam disc 40 is rotated through one half turn during one half turn of the cam mechanism, the deflection lever 58 is deflected, via its roller 60 by the cam disc 40. As a result, the cord 46 is tensioned. As a result of this tensioning, the guide roller 50, and hence the printing head 49, is withdrawn from the platen 53 in the direction of the arrow shown in FIG. 1. In this withdrawn position, the cam mechanism comes to a standstill as a result of the cam 62 actuating the microswitch 41. The microswitch 41 switches off the electric motor 1 and hence also the drive for the common drive shaft 37. The roller 61 of the locking lever 43 prevents shifting of the half-turn coupling. When as the printing head 49 is to be moved towards the platen 53 in the direction of the arrow, the electric motor 1 is switched on again and the half-turn coupling is rotated through a further half-turn via the pawl-and-ratchet device 44. As soon as the cam 62 reaches the position which is shown in FIG. 3, the microswitch 42 is actuated to initiate a reversal on the electric motor 1. During this half turn of the half-turn coupling, the deflection lever 58 again assumes the position shown in FIG. 3, thus slackening the cord 46. As a result of a spring force (not shown), the printing head 49 is moved in the direction of the platen 53.

After reversal of the electric motor 1, the pawl-and-ratchet device 65 is activated by the reversal of the direction of the drive shaft 37, and hence the ribbon transport or, if necessary, the ribbon reversal is also activated.

The ribbon 17 is provided on both ends with eyelets 18, one of which is shown in FIG. 4. The eyelets 18 cause deflection of the associated control levers 19 and 20.

The control levers 19 and 20 are pivotally journalled in bearings 21 and 22 on the housing walls 36 and 361. At one of their ends they are rigidly coupled to each other by a connection rod 23. This means that they always perform the same movements. At their other end, the control levers 19 and 20 are provided with fork-shaped projections 31 and 30 which guide the ribbon 17.

At the area of the lever 19, a roller lever 24 is slidably arranged on the housing wall 36. The roller lever 24 slides perpendicularly to the control shaft 8 in the plane of the drawing. In its rest position (as shown), the roller lever 24 is held by the force of a tension spring 25. In the operating range of the roller lever 24, the upper portion of cam face 34 of the lever 19 has the shape of a shallow inverted V so that the guide surface for the roller lever 24 thus consists of a slope 341 and a slope 342. In the present embodiment, the control lever 20 also has these slopes 341, 342. This is done mainly for the purpose of manufacturing, because the control levers 19 and 20 may then be identical punched products. Furthermore, the control levers 19 and 20 are provided with projections 33 and 26 which bear on the gearwheels 7 and 9 in the active position of the control levers 19 and 20 and which are lifted off the gearwheels 7, 9 in the rest position of these levers 19, 20. The position of the control lever 20 which is shown at the right in FIG. 4 thus represents the active position, while the position of the control lever 19 shown at the left in FIG. 4 is the rest position.

When the ribbon 17 is transported in the direction of the arrow, i.e., when it is unwound from the feed reel 12, the eyelet 18, when the end of the ribbon 17 is reached, strikes against the projection 31 of the control lever 19 and rotates the lever 19 in the direction of the arrow. As a result, the roller lever 24 is shifted upwards against the force of the spring 25, until the roller lever 24 passes over the top of the cam face 34. At this instant, after travelling the distance 32, the projection 33 comes to bear on the gearwheel 7. At the same time, the force exerted on the slope 342 by the spring 25 via the roller lever 24 becomes effective. As a result of the parallelogram of forces then occurring, the projection 33 exerts a force on the gearwheel 7 which acts axially on the control shaft 8, thus sliding this shaft 8. Upon the movement of the control lever 19 until the projection 33 abuts against the gearwheel 7, the projection 26 of the control lever 20 is lifted off the gearwheel 9 via the connection rod 23. As a result, the axially acting force exerted on the control shaft 8 by the control lever 19 is not opposed.

After the sliding of the control shaft 8, the gearwheel 7 again engages the gear ring 141. As a result, the ribbon 17 is transported in the opposite direction to the arrow. The control lever 19 remains in its operating position in which the roller lever 24 is in engagement with the slope 342 of the cam face 34. When the ribbon 17 has been unwound in the direction opposite to the arrow in FIG. 4, the eyelet 18 provided at the right-hand end of the ribbon 17 (not shown) strikes the projection 30 of the lever 20. As a result, the lever 20 is deflected in the described manner until the projection 26 contacts the gearwheel 9. Through the connection rod 23, the control lever 19 has been deflected by the same amount and the roller lever 24 has been lifted, against the force of the spring 25, over the top of the cam face 34. After that, the force of the spring 25 again acts on the lever 19 and, via the connection rod 23, also on the control lever 20 which slides the control shaft 8 to the left. This means that the length of the slope 341 must be slightly smaller, measured from the top of the cam face 34, than the distance between the projection 33 of the control lever 19 and the gearwheel 7 in the operative position of the lever 19 and that the length of the slope 342 must be slightly smaller, measured from the top of the cam face 34, than the distance between the projection 26 of the control lever 20 and the gearwheel 9 in the inoperative position of the lever 20. The length is to be understood to mean herein the distance between the top of the cam face 34 and the bearing point of the roller lever 24 on the respective slope 341, 342.

The sliding of the shaft 8 and the two gearwheels 7 and 9 in each direction is limited by the abutting of the conical faces 71 , 91, against the conical faces 142, 132, respectively, of the reel holders 14, 13, respectively. If the slope 341 and the slope 342 are sloped more steeply than is required merely for reversal, forces are applied to the control shaft 8 by the spring 25 which intensify the frictional forces between the conical faces 71, 91 of the gearwheels 7 and 9 and the conical faces 142, 132 of the reel holders 14 and 13. The frictional forces then remain constant also in the event of wear.

As best seen in FIG. 3 two recesses 100 are provided which are engaged by locking lever 43 to lock the deflection lever 58.

What is claimed is

1. A printing device which includes: an ink ribbon, a printing head, a platen and means for transporting and reversing the transport direction of said ink ribbon and for withdrawing said printing head from said platen which comprises first and second gear wheels, a control shaft fixed to each of said gear wheels, first and second gear rings on reel holders disposed on the sides of said printing device, said gear wheels alternately engaging, by sliding of the control shaft in the longitudinal direction, one of said gear rings, said device further including a cord and guide rollers on said printing head, said cord being guided over said printing head via said guide rollers, the withdrawal of said printing head being effected by the tensioning of said cord, one of said gear wheels cooperating with said gear rings on said reel holders being coupled via a first pawl-and-ratchet device to a common drive shaft, said device further including a deflection lever and a cam mechanism which includes a cam disc, said cam disc being connected to said common drive shaft via a second pawl-and-ratchet device, said first and second pawl-and-ratchet devices being arranged to drive in opposite directions, and said common shaft being drivable in a reversible manner by means of a single electric motor.

2. A drive as claimed in claim 1, wherein said cam mechanism further includes a second cam disc, which is provided with two recesses which are arranged in approximately diametrically opposite positions and a locking lever which selectively engages to lock the deflection lever in one or the other of two positions.

3. A drive as claimed in claim 1 or 2, wherein said electric motor is reversible.

4. A drive as claimed in claim 1, wherein each cooperating gear wheel and cooperating gear ring comprise conical faces which face each other and slide on each other in opposed directions when the gear wheel and the gear ring of which they are part do not mesh with each other.

5. A device as claimed in claim 1, 2 or 4 further including means for a reversal of the transport direction of the ribbon which includes a control lever cooperating with each gear wheel on said control shaft, each control lever being deflectable by said ribbon against the face of the associate gear wheel, at least one of said control levers having associated with it a roller lever which is slidably mounted.

* * * * *